United States Patent [19]

Schuerman

[11] Patent Number: 4,920,677

[45] Date of Patent: May 1, 1990

[54] BOLT ACTION RIFLE

[76] Inventor: Dale E. Schuerman, 10335 N. Scottsdale Rd., Suite B, Scottsdale, Ariz. 85253

[21] Appl. No.: 367,886

[22] Filed: Jun. 19, 1989

[51] Int. Cl.[5] ..... F41A 3/22
[52] U.S. Cl. ..... 42/16; 42/25
[58] Field of Search ..... 42/16, 25

[56] References Cited

U.S. PATENT DOCUMENTS 2,509,043 5/1950 Mühleman .
3,707,795 1/1973 Bielfeldt .
3,835,566 9/1974 Bielfeldt et al. .

FOREIGN PATENT DOCUMENTS 759051 12/1950 Austria ..... 42/16
386921 6/1908 France ..... 42/16

OTHER PUBLICATIONS

Sundra, The Mauser Rifle Story, Guns & Ammo, Sep. 1985, pp. 46, 52.

*Primary Examiner*—Charles T. Jordan
*Assistant Examiner*—Richard W. Wendtland
*Attorney, Agent, or Firm*—Kenneth R. Bowers, Jr.

[57] ABSTRACT

A bolt action rifle having a flange projecting from a ring captured between the barrel and the receiver, the flange mating with the undercut in the bolt needed to pass the cartridge during loading into the grip of the extractor to achieve controlled round feeding, the flange serving to support the cartridge during detonation in the area of the cartridge which otherwise would be unsupported.

The mating of the flange with the undercut of the bolt requires a non-rotating bolt. An inner bolt sleeve is provided, axial movement thereof serving to control rotating locking lugs at the front of the bolt which lock the bolt during detonation.

7 Claims, 3 Drawing Sheets

R
F
B
B
3
3

F
R
U
D

BOLT ACTION RIFLE

BACKGROUND OF THE INVENTION

1. Field of the Invention

This invention relates to firearms generally, and particularly relates to a breech-loading, repeating bolt action rifle.

2. Description of the Prior Art

A bolt action rifle is a firearm which is defined by the mechanism used to insert cartridges into the firing chamber. Most rifles have a magazine for the storage of cartridges from which cartridges are stripped under spring pressure, one at a time, for insertion into firing position. While being stripped, and once stripped, the cartridge round in a bolt action rifle is impelled forward by a structure called the bolt. The bolt is generally hand operated by the user.

A breech loading rifle is defined as a firearm in which a cartridge is loaded into the rear of the barrel.

The literature and history relating to breech loading bolt action rifles is both extensive and complex. The rifle models manufactured by Paul Mauser as the Mauser Model 1898 have achieved special fame and are described in an article "The Mauser Rifle Story" by Jon Sundra, Guns & Ammo, September, 1985, and by "The Bolt Action", by Stuart Otteson, Volume I, Wolfe Publishing Co. Inc., ISBN 0-935632-21-2, 1976.

U.S. Pat. No. 3,835, 566 to Bielfeldt et al. is descriptive of a bolt action rifle.

The Sundra article, on page 52, describes a problem called "double loading". Many bolt action designs allow that the cartridge is not under direct control by the bolt during insertion but rather the cartridge is merely pushed forward toward the firing chamber. If for any reason, such as panic, the operator fails to fully insert the cartridge by complete and proper travel of the bolt, it is possible to leave an unspent cartridge in the rifle and to reverse the bolt ("short stroking") to return to strip out a second cartridge from the magazine. When the bolt is used to insert the second cartridge, the point of the second cartridge encounters the rear of the first unejected cartridge and may detonate the first cartridge or may merely jam the loading mechanism.

The double loading problem was recognized by Paul Mauser and corrected in his design known as the Spanish Mauser 1891. This rifle provided for a bolt which rotated about its axis prior to movement longitudinally toward and away from the firing chamber. At the rear-most position of the bolt, the bolt face stops behind the magazine. The bolt has an undercut bolt head rim which receives the cartridge rim. A non-rotating extractor captures the cartridge after it jumps free of the magazine. Thus, if the bolt is drawn rearward at any time, it pulls the cartridge with it and ejects the cartridge normally from the rifle before a new cartridge is stripped from the magazine. This mechanism effectively prevents double loading malfunctions.

The Mauser 1891 design introduced a new problem in exchange for the elimination of double loading. The undercut to the face of the bolt leaves a portion of the cartridge unsupported during firing.

It is usual to manufacture cartridge cases of brass, a material which has insufficient strength to withstand the gas pressures generated by the detonation of the cartridge. The cartridge expands during detonation and bears against the stronger steel surfaces which surround it, generally that of the bolt face and the barrel. In the direction of the barrel axis, gas pressure is relieved by propelling the rifle bullet forward.

In the area of the undercut of the bolt face, a portion of the cartridge rim is not supported. That is, the cartridge must expand excessively to encounter support steel. This lack of support results in occasional cartridge rupture, producing a flux of brass particles and high pressure gas through the mechanism of the rifle and outward via available clearances.

Efforts to more effectively seal the breech involved decreasing the area of nonsupport by decreasing the bolt rim height or by milling projections from the rear of the barrel. This resulted in a decrease of feeding reliability and/or involved complex machining and difficult fitting of breech components. Because of the otherwise extreme reliability, the basic design of the Mauser rifle bolt and extractor were closely imitated by military bolt action rifles. Many commercial rifles, in contrast, use fully-enclosing bolt faces which combine with the barrel to fully enclose the cartridge during firing. These rifles do not preclude double loading.

An object of this invention is to provide a bolt action rifle design which simultaneously allows for controlled round feeding to prevent double loading and for a fully supported cartridge to help prevent and contain a cartridge rupture, resulting in increased reliability and safety.

SUMMARY OF THE INVENTION

The invention is a repeating bolt action rifle of the Mauser type having a non-rotating extractor attached to a non-rotating bolt. The bolt head rim is undercut allowing controlled round feeding as in Mauser pattern designs. In this invention the bolt does not rotate and therefore permits a mating projection to occupy the space left open by the bolt rim undercut. The projection supports the cartridge case during detonation and seals a portion of the breech in the event of cartridge rupture.

The projection is not integral to the barrel but rather is a separate ring-shaped part held in place between the barrel and the receiver, which ring has a flange projecting therefrom to mate with and fill the undercut of the bolt.

The bolt mechanism of the rifle is non-rotating to enable the projecting flange to mate with the undercut. An inner bolt sleeve slides axially along and within an outer bolt sleeve, extending and retracting a plurality of lugs at the forward end of the bolt dovetailed into the inner bolt sleeve, into and out of bracing contact between the receiver and the barrel to lock the firearm for firing when needed. A stud at the rear end of the inner bolt sleeve engages a spiral groove in a rotating bolt collar which is controlled by the operator via a bolt handle. Rotation of the bolt collar is converted to axial movement of the inner bolt sleeve by sliding of the stud in the spiral groove. The bolt mechanism also has a firing pin which is cocked by axial motion of the inner bolt sleeve, and a bolt collar lock to prevent bolt collar rotation with the bolt in its rear-most position.

DETAILED DESCRIPTION

Figures 1, 2, 5, 6:
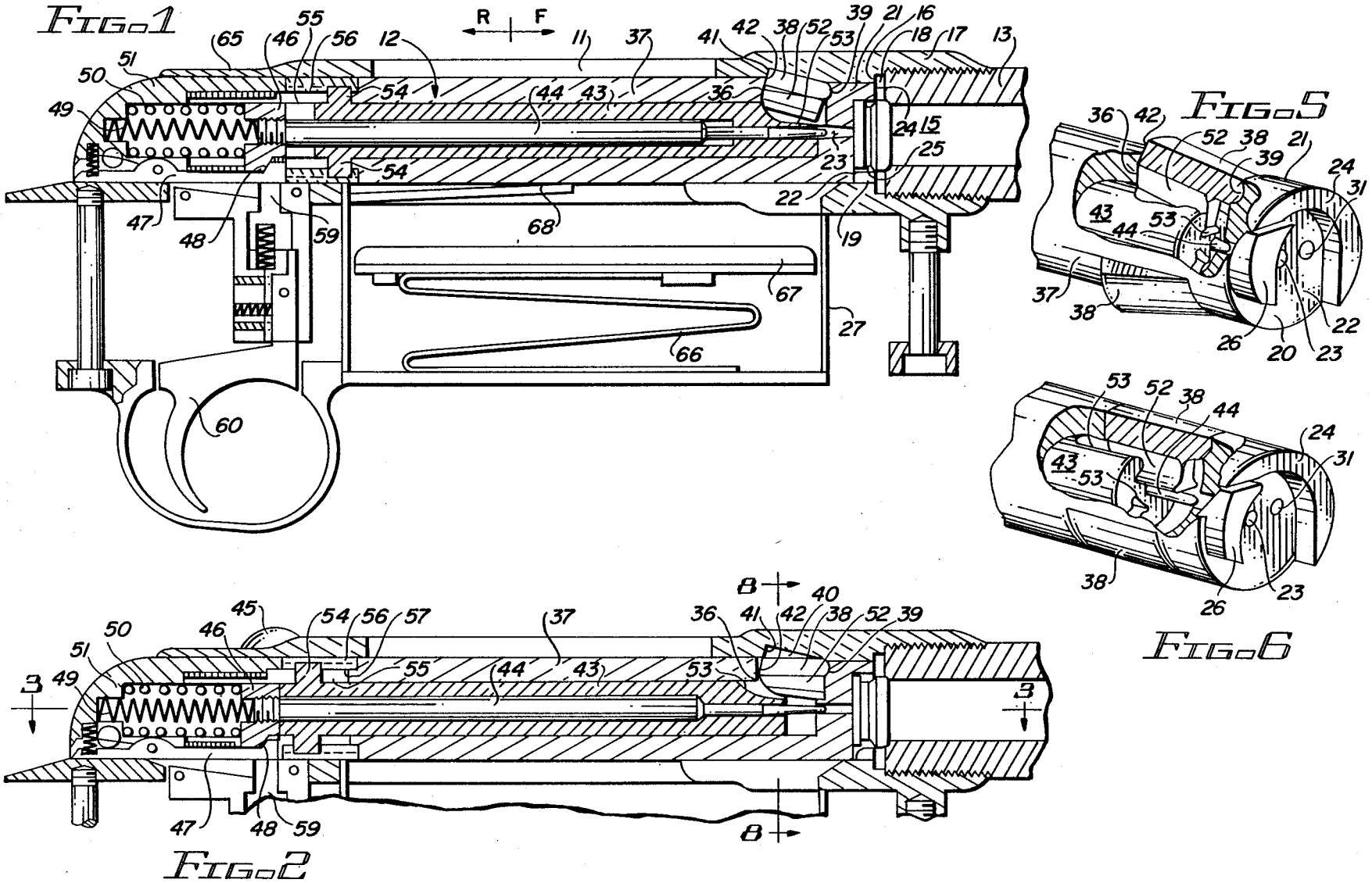
FIG. 1 is a partial side elevation view of a bolt action rifle as modified by this invention, shown locked closed in a ready-to-fire position with a loaded cartridge.
FIG. 2 is a partial side elevation view of the invented bolt action rifle with the bolt handle in its fully raised position and with the locking lugs in the unlocked position.
FIG. 5 is a partial perspective view of the bolt with its locking lugs in the locked position.
FIG. 6 is a partial perspective view of the bolt with its locking lugs in the unlocked position.

While this description is intended to fully describe the invention, nevertheless the material in U.S. Pat. No. 3,835,566 to Bielfeldt et al, incorporated herein by reference, may aid in a full understanding.

In the claims, in the drawings and in this description, similar numerals denote similar features.

Referring to FIG. 1, the mechanism is shown to have a receiver 11 which is of roughly cylindrical shape bored out longitudinally to accept an axially slidable (along F and R) bolt assembly 12. Numeral 12 refers to the total bolt assembly. A barrel 13, shown in part, is attached by screw threads to a forward end of receiver 11. Generally speaking, receiver 11 is an enclosure which receives a cartridge and contains the mechanism, especially bolt assembly 12, which inserts the cartridge into the barrel for discharge. Barrel 13 is the component of the rifle which contains the explosively expanding gases which propel the bullet along and out barrel 13. A cartridge chamber 14 (see FIG. 4) is reamed out of the breech end of barrel 13. A cartridge 15 is shown inserted in cartridge chamber 14. A breech ring 18 is tightly captured between the breech end of barrel 13 and an inner shoulder 16 in receiver ring 17. Breech ring 18 is geometrically a thin cylinder with an annular circular hole therethrough the cylinder axis, sized to permit passage therethrough by cartridge 15. Projecting from the rear surface of breech ring 18 and integral with the body of breech ring 18 is a flange 19 which is sized and shaped to mate with and fill within the limits of engineering tolerances the entirety of bolt rim undercut 20 when bolt 12 is in its forward position. An outer surface of flange 19 is flush or coextensive with the surface of receiver ring 18 formed by the hole therethrough. (See FIGS. 1 and 4) Refer to FIG. 4 for a better view of breech ring 18 and refer to FIG. 5 for the best view of bolt rim undercut 20.

In FIG. 5, bolt head 21 at its forward surface forms bolt face 22 which is perforated at its center by firing pin hole 23. At the circumference of bolt face 22 is bolt rim 24 which surrounds cartridge 15 at extractor groove 25, seen in FIG. 1. At the bottom portion of bolt face 22 in FIG. 5, bolt rim 24 is cut away to leave a remainder of the circumference of bolt face 22 without bolt rim 24; this portion of the circumference is defined as the bolt rim undercut 20. Bolt rim undercut 20 serves to permit passage therethrough the undercut of the rim of cartridge 15, which slips under an extractor hook 26 in passage from magazine 27.

Figure 3:
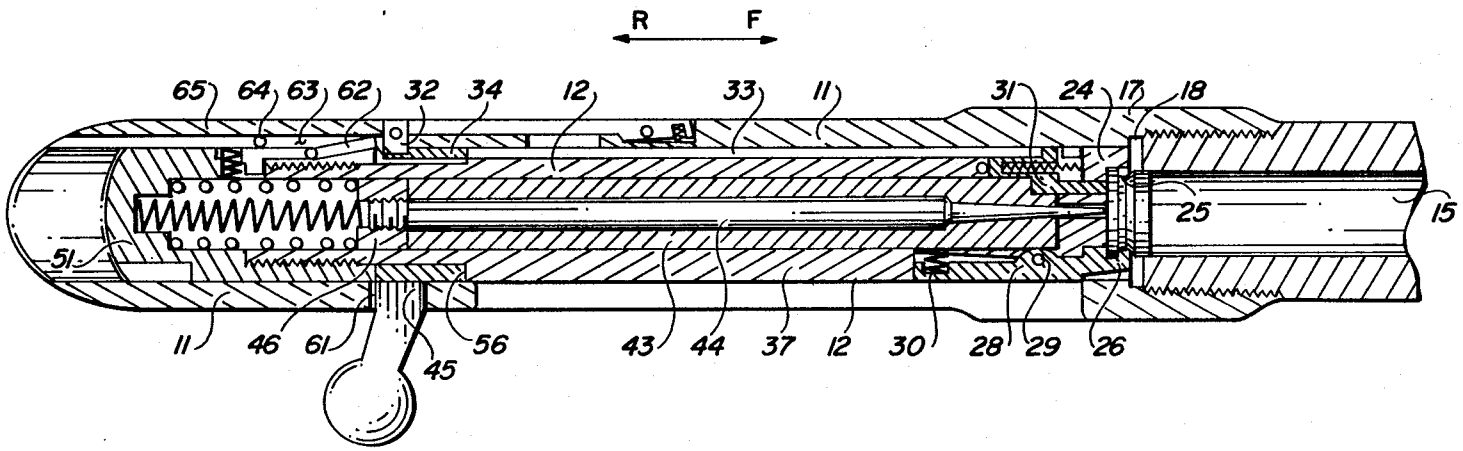
FIG. 3 is a partial plan view of the rifle in the breech area, sectioned as indicated in FIG. 2, with the firing pin in a forward firing position.

Refer to FIG. 3. Extractor 28 is mounted flush with the outside of bolt 12 in a recess close to the forward end of bolt 12. Extractor 28 is pivotally mounted with a pin 29 and is coil spring 30 loaded. An extractor hook 26 passes through an undercut 20 in bolt rim 24. Extractor hook 26 is wedge shaped, as shown in FIG. 5, so that if it were blown outward by a ruptured cartridge it would wedge against bolt rim 24 at its top and against breech ring flange 19 at the bottom, effectively sealing the breech. Extractor 28, bolt rim 24 and flange 19 are also supported by the inner surface of the receiver ring 17 wall.

Again referring to FIG. 3, opposite extractor 28 on bolt 12 is an ejector 31 which is of the plunger type. Ejector 31 is spring biased toward its retracted position along R. Ejector 31 is activated by being struck at its rear by bolt stop 32 when bolt 12 is moved almost completely rearward.

Figures 4, 7, 8, 9:
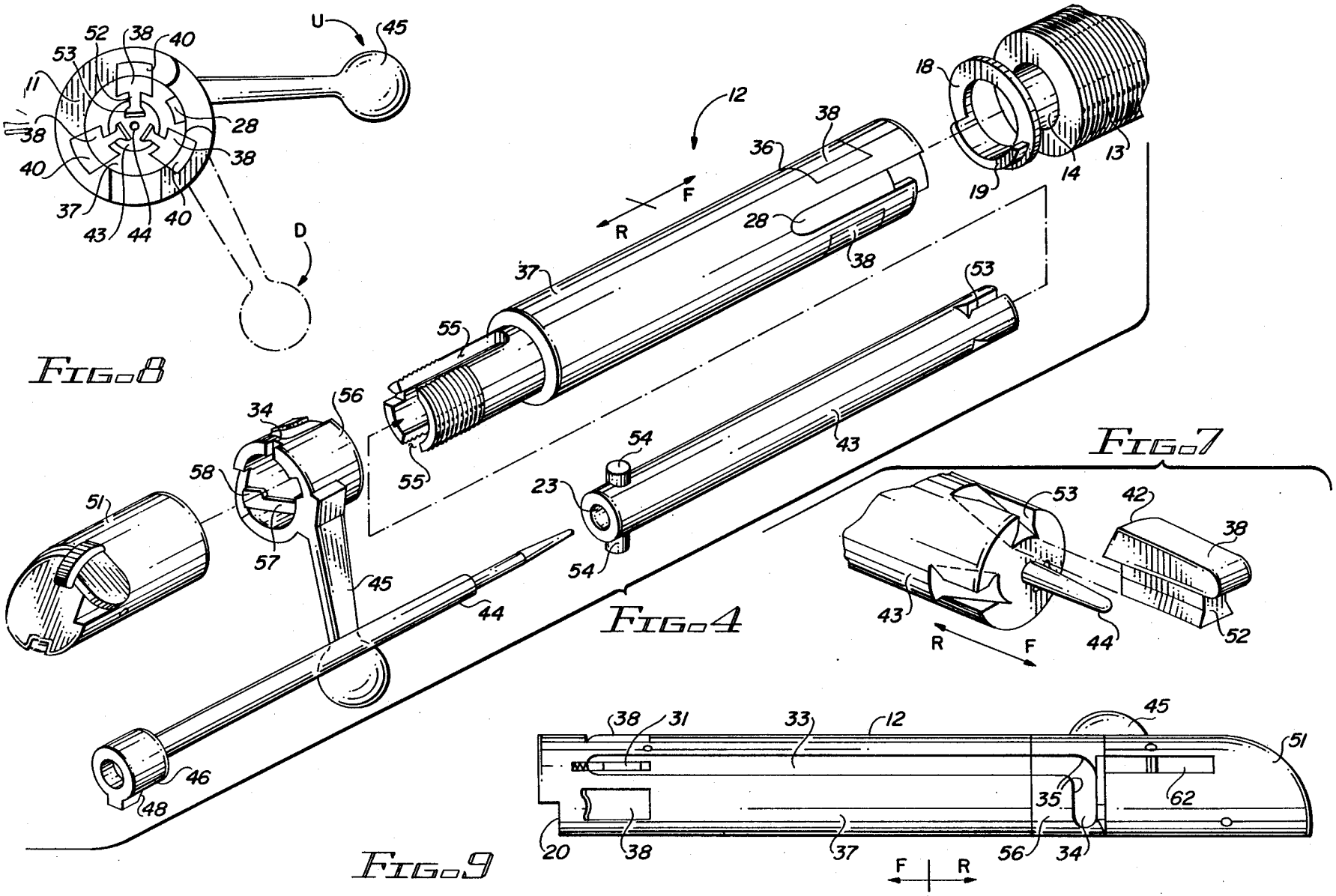
FIG. 4 is an exploded perspective view of the bolt mechanism, a perspective view of the breech ring, and a perspective view of an end of the barrel.
FIG. 7 is a schematic of a forward end of an inner bolt sleeve having several components omitted for clarity, showing a typical locking lug.
FIG. 8 is a section of the bolt and receiver taken from FIG. 2 with the locking lugs in the unlocked position.
FIG. 9 is a profile view of the outer surface of the bolt assembly with the bolt handle in the fully raised position.

Bolt stop 32 is mounted in receiver 11 and rides in a longitudinal bolt guide groove 33 seen in FIGS. 3 and 9 on the outer surface of bolt body 12. Bolt stop 32 thus also acts as a bolt guide and ejector actuator. During the phase of bolt operation when bolt 12 is forward, bolt stop 32, seen in FIG. 3 rides in a circumferential groove 34 on the outer surface of collar 56, best seen in FIG. 9. Circumferential groove 34 curves forward to index with bolt guide groove 33. At the curved section are chambering and extraction camming surfaces 35.

As may be seen in FIGS. 1 and 2, close to the front end of bolt 12, mounted in outer bolt sleeve locking lug recesses 36 in outer bolt sleeve 37 are rotating locking lugs 38. It is probably best to provide three such lugs 38, mounted 120 degrees apart around the barrel, but the exact number and spacing can vary. Lugs 38 function to transfer the force of firing recoil from bolt head 21 to receiver 11. A surface 42 of each lug 38 bears against a surface 41 of the receiver 11 when lug 38 is pivoted out in the firing position to transfer the recoil forces. In FIGS. 1 and 5, locking lugs 38 are shown in an extended out, locked bolt 12 position. In FIGS. 2 and 6, locking lugs 38 are shown in a retracted inward, bolt released position. Lugs 38 are pivotally mounted in outer bolt sleeve 37 at a forward end of lug 38 which is shaped spherically to mate with spherical axial bearing surface 39. Lugs 38 are pivotal radially from an inward withdrawn position (of FIGS. 2 and 6) to an outward locking position (of FIGS. 1 and 5) within receiver locking lug recesses 40.

As shown in FIGS. 1, 2, 7, and 8, pivoting locking lugs 38 are held in place at the rear end by engagement with an inner bolt sleeve 43 dovetail cutout 53, and are held at a forward end by engagement with forward axial bearing surface 39 of bolt 12. Unlike prior designs, locking lugs 38 do not have retaining pins.

Refer to FIG. 4. Bolt assembly 12 comprises an outer bolt sleeve 37 with recesses 36 to receive rotating locking lugs 38. Outer bolt sleeve 37 is longitudinally bored to accept inner bolt sleeve 43. Inner bolt sleeve 43 is also longitudinally bored (hole 23) to receive firing pin 44.

Inner bolt sleeve 43 is non-rotating, but is axially shiftable relative to outer bolt sleeve 37. Inner bolt sleeve 43 is actuated to shift in directions R or F by a separate camming mechanism near the rear of bolt 12 operably connected to bolt handle 45.

As seen in FIGS. 1, 2, and 3, firing pin 44 is longitudinally shiftable within inner bolt sleeve 43. Rearward motion R of inner bolt sleeve 43 relative to outer bolt sleeve 37 causes a corresponding rearward movement of firing pin 44 due to abutment of cocking piece 46 against the rear edge of inner bolt sleeve 43. This abutment forces firing pin 44 into a retracted and cocked position. A separate firing pin retracting mechanism is not required.

Firing pin 44 is prevented from motion forward along F to a firing position until inner bolt sleeve 43 is in the forward locking position. This safety provision prevents discharge of the cartridge with the bolt unlocked.

Refer to FIG. 1. Firing pin 44 is threaded at its rear end to cocking piece 46. Cocking piece 46 engages a sear 47 at a sear notch 48.

Firing pin 44 is spring loaded by an inner mainspring 49 and an outer spring 50 which fits into rear bolt sleeve 51 and bears against the rear of cocking piece 46.

Referring to FIGS. 1 and 2, the axial movement of inner bolt sleeve 43 provides a telescopic type mechanism for actuating the forward mounted rotating locking lugs 38.

As best seen in FIGS. 1, 2, 5, 6, and 7, inclined cam surfaces in a dovetailed slot 53 at the forward end of inner bolt sleeve 43 engage projections 52 from the under surface of rotating locking lugs 38. These dovetailed slot cam surfaces 53 serve to extend locking lugs 38 to the locked position of FIGS. 1 and 5. Surfaces 53 also retract lugs 38, drawing them flush with the outer diameter of bolt 12, as shown in FIGS. 2 and 6, releasing bolt 12 to move rearward along R.

Refer to FIGS. 5, 6, 7, and 8. A dovetail cam system for the control of lugs 38 comprises a female longitudinal dovetail slot 53 which is wider at its base than at its top. Male projection 52 of lug 38 slides in slot 53. Since dovetail slot 53 is inclined as shown in FIGS. 1 and 7, axial motion of inner bolt sleeve 43 along R or F impels a radial rotation of the entire lug 38 about its end engaged in bearing surface 39.

Since slot 53 and projection 52 are dovetailed together, any significant motion between the two except longitudinal sliding is prevented. This provides positive mechanical control of locking lugs 38 via inner bolt sleeve 43.

The cam system described above does not bear the axial compression load of cartridge recoil during firing. This load is transferred to the receiver via lugs 38.

At the rearward end of inner bolt sleeve 43 are two radially extending studs 54 opposed 180 degrees from each other, as best seen in FIG. 4. These inner bolt sleeve studs 54 slide in two stud guide slots 55 milled longitudinally in the rear end of outer bolt sleeve 37. Inner bolt sleeve 43 and firing pin 44 are non-rotating and slide axially together rearward relative to outer bolt sleeve 37. This axial motion, along F and R, is mechanically impelled by up and down movement of bolt handle 45. Bolt handle 45 is attached to a cylindrically shaped bolt collar 56 which slides over the rear portion of outer bolt sleeve 37 and rotates around the axis of outer bolt sleeve 37.

Inner bolt sleeve studs 54, while riding in longitudinal stud guide slots 55, extend beyond the outer surface of outer bolt sleeve 37 as seen in FIG. 1.

Refer to FIG. 4. Inner bolt sleeve studs 54 fit in two bolt collar inner spiral grooves 57 milled into the inner surface of bolt collar 56. Inner bolt sleeve studs 54 slide in inner spiral grooves 57 in response to rotational motion of bolt collar 56.

Upward motion of bolt handle 45 causes counterclockwise (viewed from the rear along F) motion of bolt collar 56.

The left hand spiral of the bolt collar inner spiral grooves 57 urges rearward non-rotating motion of inner bolt sleeve studs 54, inner bolt sleeve 43, and firing pin 44 to the position shown in FIG. 2. Conversely, downward motion of bolt handle 45 urges forward motion of inner bolt sleeve 43 but not firing pin 44 since firing pin 44 is captured in normal operation at a rearward cocked position by a sear 47 seen in FIG. 1.

When inner bolt sleeve studs 54 are at an extreme rearward position, with continued rotation of bolt collar 56, studs 54 are held at the rear by holding notches 58 in inner spiral grooves 57 seen in FIG. 4.

Refer to FIG. 3. The root of bolt handle 45 fits in bolt handle slot 61 in receiver 11.

Refer to FIGS. 1 and 4. Rear bolt sleeve 51 is threaded to the rear of outer bolt sleeve 37. Rear bolt sleeve 51 supports bolt collar 56. Pivotally mounted in the underside of rear bolt sleeve 51 is a sear 47 which engages sear notch 48 of firing pin cocking piece 46 when cocking piece 46 is moved to an extreme rearward position. Sear 47 is mounted in bolt 12, and not in the receiver or trigger mechanism as might be usual or expected.

Sear 47 is held in its cocked position by trigger mechanism 59 when bolt 12 is closed.

When bolt collar 56 is rotated fully counterclockwise approximately 65 degrees, and bolt 12 is moved rearward, bolt collr 56 must be locked in this position or it will tend to rotate out of position. Bolt collar lock 62, shown in FIG. 3, is pivotally mounted in rear bolt sleeve 51 and is actuated by a bolt collar lock cam pin 64 mounted in a bolt collar lock groove 63 in a receiver bridge 65 by axial motion of bolt 12. Rearward motion of bolt 12 locks bolt collar 56 to rear bolt sleeve 51 and prevents rotational motion until bolt 12 is again almost completely forward.

Bolt collar lock 62 also serves as a disassembly mechanism. Bolt collar lock 62 also locks rear bolt sleeve 51 to outer bolt sleeve 37, preventing rotation of bolt 12 in receiver 11 during rotation of bolt handle 45. Rear bolt sleeve 51 is prevented from rotation by the interference fit of bolt collar lock 62 in groove 63 in receiver bridge 65.

Magazine box 27, shown in FIG. 1, contains the cartridges which are urged upward by a magazine spring 66, shown partially compressed, and follower 67. The cartridges are held in place under magazine feed lips 68.

OPERATION

Assume that magazine 27 contains cartridges and the firearm has just been discharged. The operational sequence of events which follows will aid in an understanding of the mechanical details of the rifle.

Beginning with bolt 12 in the closed and locked position as in FIG. 1, but with firing pin 44 forward as in FIG. 3, assume that the operator lifts bolt handle 45 upward through an arc of approximately 65 degrees to the position of FIGS. 2 and 8. This lifting motion rotates bolt collar 56 counterclockwise. Studs 54 projecting from inner bolt sleeve 43 slide axially in stud guide slots 55 in outer bolt sleeve 37. Studs 54 also slide in inner spiral grooves 57 in bolt collar 56. Studs 54 and inner bolt sleeve 43 are urged rearward in the direction R. As inner bolt sleeve 43 is forced rearward, dovetailed slot 53 engages projection 52 of locking lugs 38 and urges locking lugs 38 downward out of receiver locking lug recesses 40 to a position flush with the outer surface of outer bolt sleeve 37 as seen in FIGS. 2 and 6. Simultaneously, the rearward movement of inner bolt sleeve 43 retracts firing pin 44 against the pressure of inner and outer mainsprings 49 and 50. At the extreme rearward position, firing pin cocking piece 46 is engaged at sear notch 48 by sear 47 mounted in rear bolt sleeve 51 as shown in FIG. 2.

During the last phase of bolt collar 56 rotation, bolt collar 56 and thus the entire bolt 12, is cammed rearward a small distance by bolt stop 32 contact with extraction cam surface 35 as shown in FIG. 9. The discharged cartridge, held to bolt face 22 by extractor hook 26, is removed a small distance along R from chamber 14, releasing the cartridge in case it is somewhat jammed. Bolt assembly 12 is now unlocked as in FIGS. 2 and 6, and free to move rearward.

Assume that the operator now moves bolt handle 45 along R to its extreme rearward position.

During rearward motion of bolt assembly 12, bolt collar lock 62 engages bolt collar lock cam pin 64 in bolt collar lock groove 63 in receiver bridge 65. This locks bolt collar 56 in position during the time bolt 12 is not completely forward.

As bolt 12 is moved rearward, bolt stop 32 is engaged in bolt guide groove 33. This engagement prevents rotation of bolt assembly 12 in receiver 11 and guides bolt 12 smoothly forward and backward.

As bolt 12 moves rearward, extractor 28 pulls cartridge 15 with it. As bolt 12 nears its rearmost position, bolt stop 32 strikes ejector 31 causing ejector 31 to strike the base of cartridge 15, ejecting cartridge 15 out of the ejection port of receiver 11.

At this point, a fresh cartridge moves up from magazine 27 to engagement with magazine feed lips 68. The rim of the cartridge will contact bolt face 22 at rim undercut 20 when bolt 12 is pushed forward along F.

As bolt 12 is pushed forward along F by the operator, the cartridge is pushed longitudinally under magazine feed lips 68 until the cartridge is free of contact with lips 68 and leaps upward. At that moment, the cartridge slides under extractor hook 26 and is captured and placed under control of extractor 28. If bolt 12 is moved rearward at this point, for any reason, but especially if bolt 12 is moved rearward in error by a frightened operator, cartridge 15 will follow the bolt and will be ejected before a new cartridge could be received from magazine 27.

In normal operation, cartridge 15 will be fed into chamber 14 as bolt 12 is moved to its forward position. Bolt collar lock 62 would be cammed to its unlocking position as in FIG. 1, allowing bolt handle 45 to be lowered.

As bolt handle 45 is lowered from position U (up) to position D (down) in FIG. 8, there is a cam forward displacement of bolt collar 56 by contact of bolt stop 32 with chambering cam surface 35 at the circumferential groove 34 shown in FIG. 9. Also, inner bolt sleeve 43 moves forward through its mechanical linkage to bolt collar 56. Firing pin cocking piece 46, having been engaged by sear 47, remains at its rearward position until sear 47 is released by trigger mechanism 59.

The surfaces of dovetail cams 53 at the forward end of inner bolt sleeve 43 cam rotating locking lugs 38 outward into receiver locking lug recesses 40, into the position shown in FIGS. 1 and 5.

Movement of outer bolt sleeve 37 forward along F toward barrel 13 has accomplished insertion of flange 19 into bolt rim undercut 20. Flange 19 fills undercut 20 completely within engineering tolerance.

The firearm is now ready for firing. Movement of trigger piece 60 to the rear releases sear 47, releasing firing pin 44. Under spring pressure, firing pin 44 moves rapidly forward, to the position of FIG. 3, striking cartridge 15 and detonating it.

For interpretation of the claims, the terms cartridge, receiver, extractor, barrel, and bolt are intended to have the meaning usual and common in the art of bolt action firearms. The following definitions are not exclusive, but inclusive and illustrative, of the general understanding of these terms to be gained from the art widely known to persons of ordinary skill in the manufacture of firearms. A cartridge is a case of approximately cylindrical geometry having a bullet or projectile at one end and containing an explosive propellant. A barrel is an elongated member having a cavity therethrough for supporting the cartridge during detonation and for guiding the projectile. The receiver is a structure attached to the barrel which contains the bolt mechanism for inserting the cartridge into the barrel. The firing chamber is a cavity partially formed by abutment of the bolt against the barrel which cavity supports the case of the cartridge. The extractor is a device which seizes the cartridge and pulls it out of the firing chamber after firing.

Other terms used in the claims, especially controlled round feeding, double loading, and undercut, are defined in this specification as well as generally in widely available literature.

I claim:

1. A bolt action rifle comprising firing chamber means for the support of the entirety of the surface of the cartridge case during detonation exclusive only of such area of such cartridge case as must unavoidably be unsupported due to engineering tolerances in the fit together of manufactured components wherein said firing chamber means comprises a cavity formed by the abutment together of a non-rotating bolt, an extractor hook (26), a breech ring (18), and a barrel, said cavity sized and shaped to entirely surround, contact, and support the case of a cartridge inserted therein said cavity, said extractor hook attached to said bolt and movable therewith, said extractor hook adapted to seize said cartridge forcing said cartridge to move with said bolt during both movement of said bolt toward and away from said firing chamber means abutment-formed cavity such that the resulting controlled round feeding prevents double loading because an improperly retracted bolt ejects a firstly inserted cartridge before a second cartridge can be inserted into said abutment-formed cavity, said breech ring (18) having a flange adapted to fill entirely within engineering tolerances an undercut (20) in said bolt not filled by said extractor hook such that mutual abutment of said flanged breech ring 18, barrel, extractor hook, and bolt form the described cavity which provides support for said cartridge during detonation preventing cartridge rupture due to non-support and sealing said rifle mechanism to contain debris from a cartridge rupture.

2. The bolt action rifle of claim 1 wherein said barrel is geometrically an annular cylinder and said breech ring (18), is geometrically a thin annular cylindrical disc with a flange (19) extending from a circular surface of said disc, a surface of said flange flush with the surface of the annulus through said cylindrical disc, said flange adapted in size and shape to mate with an undercut (20) in said bolt, and entirely fill within engineering tolerances for manufactured components such portion of said undercut not filled by said extractor hook such that said cartridge case is fully supported during detonation.

3. The bolt action rifle of claim 1 in which said bolt comprises an outer bolt sleeve (37), geometrically an elongated cylinder bored to have an annulus therethrough, containing slidably within said annulus an inner bolt sleeve (43), said inner bolt sleeve having at a first end located near said firing chamber at least one dovetail slot (53) cut into the body of said inner bolt sleeve, said at least one dovetail slot adapted to slidably receive a projection (52) integral to a locking lug (38) which locking lug 38 is in juxtaposition with openings in said outer bolt sleeve, and said lug being rotatable in response to sliding movement of said inner bolt sleeve such that forward movement of said inner bolt sleeve forces rotation of said lug through an opening in said outer bolt sleeve to engage a recess (40) in said receiver and lock said bolt from movement away from said firing chamber by bracing contact of said lug between said outer bolt sleeve and said receiver, the geometric fit of said lug in said at least one dovetail slot adapted to translate linear motion of said inner bolt sleeve toward and away from said firing chamber into rotation of said lug into and out of bracing contact between said receiver and said outer bolt sleeve such that said inner bolt sleeve serves to control said lug by axial motion of said inner bolt sleeve.

4. The bolt action rifle of claim 1 in which said bolt comprises an outer bolt sleeve (37), geometrically an elongated cylinder bored to have an annulus therethrough, containing slidably within said annulus an inner bolt sleeve (43), said inner bolt sleeve having at a first end located near said firing chamber at least one dovetail slot (53) cut into the body of said inner bolt sleeve, said at least one dovetail slot adapted to slidably receive a projection (52) integral to a locking lug (38) which locking lug 38 is in juxtaposition with openings in said outer bolt sleeve, and said lug being rotatable in response to sliding movement of said inner bolt sleeve such that forward movement of said inner bolt sleeve forces rotation of said lug through an opening in said outer bolt sleeve to engage a recess (40) in said receiver and lock said bolt from movement away from said firing chamber by bracing contact of said lug between said outer bolt sleeve and said receiver, the geometric fit of said lug in said at least one dovetail slot adapted to translate linear motion of said inner bolt sleeve toward and away from said firing chamber into rotation of said lug into and out of bracing contact between said receiver and said outer bolt sleeve such that said inner bolt sleeve serves to control said lug by axial movement thereof, said inner bolt sleeve having at a second end disposed the length of said inner bolt sleeve from said first end, said second end being therefore disposed away from said firing chamber, at least one projecting stud (54) slidably engaged in a groove (57) in the body of a rotatable bolt collar (56), said groove being spiral, such that rotation of said bolt collar by an operator of said rifle translates such rotary motion into axial movement of said inner bolt sleeve to rotate said lugs by the slide of said at least one projecting stud in said spiral groove.

5. A bolt action rifle according to claim 1 in which said bolt has a hole broad therethrough and a firing pin (44) slidably mounted in said hole, said firing pin having attached at one end a firing pin cocking piece (46) which projects away from said firing pin at a right angle to the axis of said firing pin and which projection (48) is capturable by a bolt mounted sear (47) attached to said bolt, capture of said cocking piece by said sear serving to fix said firing pin in a position in which at least one spring adopted to impel said firing pin forward toward said cartridge is compressed in an energy stored state such that said firing pin is ready when released to move forward to strike and detonate said cartridge, said energy stored state defined as "cocked".

6. The bolt action rifle of claim 1 in which said bolt comprises an outer bolt sleeve (37), geometrically an elongated cylinder bored to have an annulus therethrough, containing slidably within said annulus an inner bolt sleeve (43), said inner bolt sleeve having at a first end located near said firing chamber at least one dovetail slot (53) cut into the body of said inner bolt sleeve, said at least one dovetail slot adapted to slidably receive a projection (52) integral to a locking lug (38) which locking lug 38 is in juxtaposition with openings in said outer bolt sleeve, and said lug being rotatable in response to sliding movement of said inner bolt sleeve such that forward movement of said inner bolt sleeve forces rotation of said lug through an opening in said outer bolt sleeve to engage a recess (40) in said receiver and lock said bolt from movement away from said firing chamber by bracing contact of said lug between said outer bolt sleeve and said receiver, the geometric fit of said lug in said at least one dovetail slot adapted to translate linear motion of said inner bolt sleeve toward and away from said firing chamber into rotation of said lug into and out of bracing contact between said receiver and said outer bolt sleeve such that said inner bolt sleeve serves to control said lug by axial movement thereof, said inner bolt sleeve having at a second end disposed the length of said inner bolt sleeve from said first end, said second end being therefore disposed away from said firing chamber, at least one projecting stud (54) slidably engaged in a groove (57) in the body of a rotatable bolt collar (56), said groove being spiral, such that rotation of said bolt collar by an operator of said rifle translates such rotary motion into axial movement of said inner bolt sleeve to rotate said lugs by the slide of said at least one projecting stud in said spiral groove, having a rear bolt sleeve (51) attached to said outer bolt sleeve (37) and a cam actuated bolt collar lock (62) attached to said rear bolt sleeve adapted to lock said bolt collar (56) from rotation in a position away from said firing chamber.

7. A bolt action rifle comprising firing chamber means for the support of the entirety of the surface of the cartridge case during detonation exclusive only of such area of such cartridge case as must unavoidably by unsupported due to engineering tolerances in the fit together of manufactured components wherein said firing chamber means comprises a cavity formed by the abutment together of a non-rotating bolt, an extractor hook (26), a breech ring (18), and a barrel, said cavity sized and shaped to entirely surround, contact, and support the case of a cartridge inserted therein said cavity, said extractor hook attached to said bolt and movable therewith, said extractor hook adapted to seize said cartridge forcing said cartridge to move with said bolt during both movement of said bolt toward and away from said firing chamber means abutment-formed cavity such that the resulting controlled round feeding prevents double loading because an improperly retracted bolt ejects a firstly inserted cartridge before a second cartridge can be inserted into said abutment-formed cavity, said breech ring (18) having a flange adapted to fill entirely within engineering tolerances an undercut (20) in said bolt not filled by said extractor hook such that mutual abutment of said flanged breech ring 18, barrel, extractor hook, and bolt form the described cavity which provides support for said cartridge during detonation preventing cartridge rupture due to non-support and sealing said rifle mechanism to contain debris from a cartridge rupture, in which said non-rotating bolt comprises an outer bolt sleeve (37), geometrically an elongated cylinder bored to have an annulus therethrough, containing slidably within said annulus an inner bolt sleeve (43), said inner bolt sleeve having at a first end located near said firing chamber at least one dovetail slot (53) but into the body of said inner bolt sleeve, said at least one dovetail slot adapted to slidably receive a projection (52) integral to a locking lug (38) which locking lug 38 is in juxtaposition with openings in said outer bolt sleeve, and said lug being rotatable in response to sliding movement of said inner bolt sleeve such that forward movement of said inner bolt sleeve forces rotation of said lug through an opening in said outer bolt sleeve to engage a recess (40) in said receiver and lock said bolt from movement away from said firing chamber by bracing contact of said lug between said outer bolt sleeve and said receiver, the geometric fit of said lug in said at least one dovetail slot adapted to translate linear motion of said inner bolt sleeve toward and away from said firing chamber into rotation of said lug into and out of bracing contact between said receiver and said outer bolt sleeve such that said inner bolt sleeve serves to control said lug by axial movement of said inner bolt sleeve, wherein said dovetail slots 53 are wider at the base than at the top to capture and guide engagement with a projection 52 of lugs 38, slots 53 moreover being inclined radially with respect to bolt sleeve 43 such that the slide of lugs 38 in slots 53 as impelled by axial movement of bolt sleeve 43 urges a radial movement of lugs 38.

* * * * *